US006433480B1

(12) United States Patent
Stark et al.

(10) Patent No.: US 6,433,480 B1
(45) Date of Patent: Aug. 13, 2002

(54) DIRECT CURRENT HIGH-PRESSURE GLOW DISCHARGES

(75) Inventors: Robert H. Stark; Karl H. Schoenbach, both of Norfolk, VA (US)

(73) Assignee: Old Dominion University, Norfolk, VA (US)

( * ) Notice: Subject to any disclaimer, the term of this patent is extended or adjusted under 35 U.S.C. 154(b) by 0 days.

(21) Appl. No.: 09/579,875

(22) Filed: May 27, 2000

Related U.S. Application Data

(60) Provisional application No. 60/136,550, filed on May 28, 1999, and provisional application No. 60/136,554, filed on May 28, 1999.

(51) Int. Cl.[7] ..... H01J 61/04

(52) U.S. Cl. ..... 313/631; 313/306

(58) Field of Search ..... 313/631, 356, 313/574, 618, 632, 567, 581, 306; 315/111.21

(56) References Cited

U.S. PATENT DOCUMENTS 6,005,349 A * 12/1999 Kunhardt et al. ..... 313/231.41
6,072,273 A * 6/2000 Schoenbach et al. ..... 313/491
6,194,833 B1 * 2/2001 De Temple et al. ..... 313/356

* cited by examiner

*Primary Examiner*—David V. Bruce
*Assistant Examiner*—Pamela R. Hobden
(74) *Attorney, Agent, or Firm*—Kaufman & Canoles

(57) ABSTRACT

This invention improves the stability and control of high-pressure glow discharges by means of a microhllow cathode discharge. The microhollow cathode discharge, which is sustained between two closely spaced electrodes with an opening formed in the electrodes, serves as a plasma cathode for the high-pressure glow. Small variations in the microhollow cathode discharge voltage generate large variations in the microhollow cathode discharge current and consequently in the glow discharge current. In this mode of operation the electrical characteristic of this invention resembles that of a vacuum triode. Using the microhollow cathode discharge as a plasma cathode, stable, dc discharges in argon up to atmospheric pressures can be generated. Additionally, parallel operation of these discharges allows for the generation of large volume plasmas at high gas pressure through superposition of individual glow discharges. Thus, this invention allows simultaneous generation of relatively high electron densities at relatively low temperatures with stable, direct current, homogenous glow discharge plasma at relatively high pressure.

17 Claims, 10 Drawing Sheets

DIRECT CURRENT HIGH-PRESSURE GLOW DISCHARGES

This application is a continuation of U.S. provisional patent application number 60/136,550, filed May 28, 1999 and U.S. provisional patent application number 60/136,554, filed May 28, 1999.

This invention was made in part using funds from the Federal government under contract number F49620-97-L-0228 from the United States Air Force Office of Scientific Research (AFOSR) in cooperation with the DDR&E Air Plasma Ramparts MURI program. Accordingly, the federal government has certain rights in this invention.

BACKGROUND OF THE INVENTION

1. Field of Invention

This invention relates to plasma generation.

2. Description of Related Art

Generally, it is known to generate low pressure, plasma glow discharges. These low pressure, plasma glow discharges are created in a vacuum and are difficult to sustain for any length of time. Typically, the low pressure, plasma glow discharges can be maintained in a stable, uniform state.

Plasma is a term used to describe an electrically neutral, partially ionized gas composed of ions, electrons, and neutral particles. Furthermore, plasma is a phase of matter that is distinct from solids, liquids, and normal gases because plasma is produced by either high temperatures or strong constant or time varying electric fields.

Generally, discharge plasmas are produced when free electrons are energized by electric fields in a background of neutral particles, such as atoms and/or molecules. When these free electrons are energized, the free electrons collide with the neutral particles. These collisions transfer energy from the free electrons to the neutral particles and, as a result, the originally neutral background gas becomes at least partially, and in some cases fully ionized. When this occurs, the ionized gas is able to conduct currents.

A specific class of plasmas, known as current-maintained plasmas, is produced by a glow plasma discharge or an arc plasma discharge. These current-maintained plasmas are only maintained, and are only conductive, while a current is passed through the generated plasma. Thus, if the current is removed, the plasma quickly becomes nonconductive. This is because the relaxation time for most plasmas is between ηs and μs.

The characteristics that distinguish an arc plasma discharge from a glow plasma discharge are a high gas temperature and a low cathode fan potential. However, it is possible to have a high gas temperature associated with a high cathode fall, and vice versa. Furthermore, as would be expected, there are transition points at which the characteristics of the discharge plasma change from glow plasma discharge characteristics to arc plasma discharge characteristics.

A plasma discharge encounters several intermediate stages during the transition from a glow plasma discharge to arc plasma discharge. Some of these intermediate stages are relatively stable, while other of the stages are not. However, unless the current is limited by an external method, such as, for example, a large series resistance, the final transition from a glow plasma discharge to arc plasma discharge is usually an unstable change.

Furthermore, if the current is not limited by an external method, the final transition from a glow plasma discharge to arc plasma discharge is quite rapid, and equilibrium is typically not achieved in any of the intermediate transition stages. This final transition accelerates as the pressure of the background neutral gas increases towards atmospheric pressure.

There are two basic methods that can be used to generate discharge plasmas. The first method is through external ionization. External ionization produces plasmas by using photons or charged particles. However, this method produces a weakly ionized gas at high (atmospheric) pressure. Additionally, the efficiency of external ionization is rather low, and therefore the cost of such a method relatively high.

The second method that can be used to generate plasmas is internal ionization The method of internal ionization generates electrons and ions in a self-sustained gas discharge. If the current is strongly limited, or the applied voltage is smaller than the breakdown voltage, this method can produce large volumes of weakly ionized gas. However, if the current is not limited and the voltage is high enough, there is a transition to an arc.

For example, U.S. Pat. No. 5,939,829 to Schoebach et al. merely discloses a discharge device for operation in gas at a prescribed pressure including a single cathode having a plurality of microhollows, and a single anode spaced from the cathode.

Additionally, U.S. Pat. No. 6,005,349 to Kunhardt et al. merely discloses a method and apparatus for stabilizing glow plasma discharges by suppressing the transition from glow-to-arc. The Kunhardt et al. apparatus includes a single upper electrode, a single cathode, a collar, and a perforated dielectric plate positioned over the cathode. The holes in the perforated dielectric plate provide a narrow channel to limit the overall current density. Additionally, the collar is positioned between the upper electrode and the cathode to contain the glow discharge.

Thus, methods for generating large volumes of ionized gas at high pressure typically involve ionization mechanisms wherein the energy required for the ionization is drawn from electrical energy. Examples of this kind of ionization mechanism are radio frequency (RF) and microwave discharges, barrier discharges, and pulsed corona discharges where the discharge is sustained by either alternating or pulsed fields, and steady state discharges wherein the discharge is driven by a direct current (dc) power source.

Much of the efforts in generating stable glow discharges at high pressure have focused on preventing the onset of instabilities in the regions near the electrodes, particularly in the cathode region. These regions near the electrodes are regions of higher electric field and consequently higher power density compared to the positive column of the discharge. These regions are, therefore, a cradle of instabilities, which lead to constrictions and arc formation in the discharge. The glow-to-arc transition (GAT), the development of a highly conductive channel, which shorts out the glow discharge, shows the first visible evidence near the cathode. Other instabilities which may develop in the positive column of discharges in electronegative gases, such as the attachment instability, are generally more benign than the GAT.

Segmentation of the cathode, and ballasting the individual discharge resistively has been used to prevent the onset of the GAT instability in atmospheric pressure glow discharges. The current density in the bulk of the glow discharge is known to increase linearly with pressure, whereas the current density in the cathode layer for normal mode operation increases quadratically with pressure.

In order to make the conditions in the bulk and at the cathode compatible, the current cross-section at the cathode must be reduced with increasing pressure. This was achieved by using ballasted pins as individual cathodes with cross-sections that are small compared to the area of the cathode segment. The onset of bulk instabilities can be prevented by flowing air with such a speed through the discharge that the plasma is replaced by cold air on a time scale that is small when compared to the inverse of the growth rate of the bulk instabilities.

None of these previous efforts disclose all of the benefits of the present invention, nor does the prior art teach or suggest all of the elements of the present invention.

SUMMARY OF THE INVENTION

None of the known methods for producing a glow discharge produce a high pressure, uniform, stable plasma glow discharge. Specifically, none of the known methods for producing a glow discharge produce a dc driven, high pressure, uniform, stable plasma glow discharge with relatively high electron densities, such as, for example, $10^{13}$ $cm^{-3}$ in air. It should be understood that the term "high pressure" refers to pressures that are approximately atmospheric pressures and could range from between slightly less than one atmosphere to several atmospheres.

Research on high pressure glow discharges is motivated by applications such as instantly activated reflectors and absorbers for electromagnetic radiation, surface treatment, thin film deposition, remediation and detoxification of gaseous pollution and gas lasers.

Therefore, a direct current high pressure glow discharger, according to this invention, allows simultaneous generation of relatively high electron densities at relatively low temperaures with stable, direct current, homogenous glow discharge plasma at relatively high pressure.

The direct current high pressure glow discharger, according to this invention, includes a microhollow cathode, a microhollow anode, and an additional anode spaced apart from the microhollow anode. The microhollow cathode and the microhollow anode are separated by a dielectric and a borehole is formed through the microhollow cathode, the microhollow anode, and the dielectric.

In various exemplary embodiments, the electrode distance of the microhollow cathode discharge is approximately equal to the dimension of the borehole. The microhollow cathode of this invention produces discharges that operate at low current in a Townsend mode, where in an electrode configuration the electric field is dominantly axial.

When current is increased in the direct current high pressure glow discharger, the microhollow cathode discharges transfer into the microhollow cathode mode with high radial electric fields in the cylindrical cathode fall of the discharge. The axial field in the plasma column, which serves as a virtual anode in this case, is rather small. When the microhollow cathode discharge (MHCD) operates in this mode, external fields generated by the additional, positively biased electrode in front of the microhollow anode can penetrate into an electrode cavity and force the microhollow cathode current to flow to the additional electrode.

In this manner, the MHCD serves as an electron source for a glow discharge between a microhollow anode and the additional electrode. Thus, the microhollow cathode system, according to this invention, is considered as plasma cathode, and the additional electrode is considered an anode of a microhollow cathode sustained (MCS) glow discharge.

In the plasma cathode sustained glow discharge, of this invention, the cathode fall is eliminated. Thus, the glow discharge is stable as long as the MHCD is stable, providing that the conditions in the main discharge are such that bulk instabilities are avoided.

This invention allows the MHCD current to determine the glow discharge current at a constant voltage across a main glow discharge gap. Additionally, the MHCD current can be controlled by the MHCD voltage. For example, small variations in the MHCD voltage produce large swings in the anode current. Thus, the MCS glow discharge can be used to generate patterns by individually controlling discharges in various discharge arrays.

Accordingly, this invention separately allows the threshold current required for the onset of the MCS glow discharge to activate a large volume glow discharge with relatively small voltage swings in the MHCD voltage. The relative magnitude of the voltage and the voltage swing is determined by the particular gas that is used. Therefore, when the direct current high pressure glow discharger, of this invention, operates below the threshold for onset of the MCS glow discharge, only a relatively small voltage pulse is required to turn the main discharge on. Once in the on-state, the direct current high pressure glow discharger will stay in the on state, even when the voltage pulse is turned off. This is because of the hysteresis of the main discharge.

The concept of the MHCD sustained high-pressure glow discharges can be applied to any gas or gas mixture, such as, for example, air and/or molecular and electronegative gases.

Thus, this invention produces a direct current, stable plasma discharge in atmospheric pressure air.

Thus, this invention separately elimates the conditions for glow-to-arc transition in the cathode fall region of a glow discharge by eliminating the cathode fall.

This invention separately replaces the cathode with an externally controlled electron emitter that provides electrons through external sources rather than through ion impact at the cathode.

This invention separately allows the electron emission to be adjusted to a large volume glow discharge.

This invention separately reduces the thermal losses in the cathode and reduces the requirements for cooling.

This invention separately provides microhollow cathode discharges that operate at low current in a Townsend mode.

This invention separately improves the stability of a high-pressure glow discharge.

This invention separately provides a MHCD that serves as a current valve for the glow discharge.

These and other features and advantages of this invention are described in or are apparent from the following detailed description of various exemplary embodiments of the systems and methods of this invention.

BRIEF DESCRIPTION OF THE DRAWINGS

Exemplary embodiments of the systems and methods according to this invention will be described in detail, with reference to the following figures, wherein.

DETAILED DESCRIPTION OF PREFERRED EMBODIMENTS

For simplicity and clarification, the operating principles, design factors, and layout of the direct current high pressure glow discharger systems and methods according to this invention are explained with reference to various exemplary embodiments of the direct current high pressure glow discharger systems and methods according to this invention. The basic explanation of the operation of the direct current high pressure glow discharger system is applicable for the understanding and design of the constituent components employed in the direct current high pressure glow discharger systems and methods of this invention.

Figure 1:
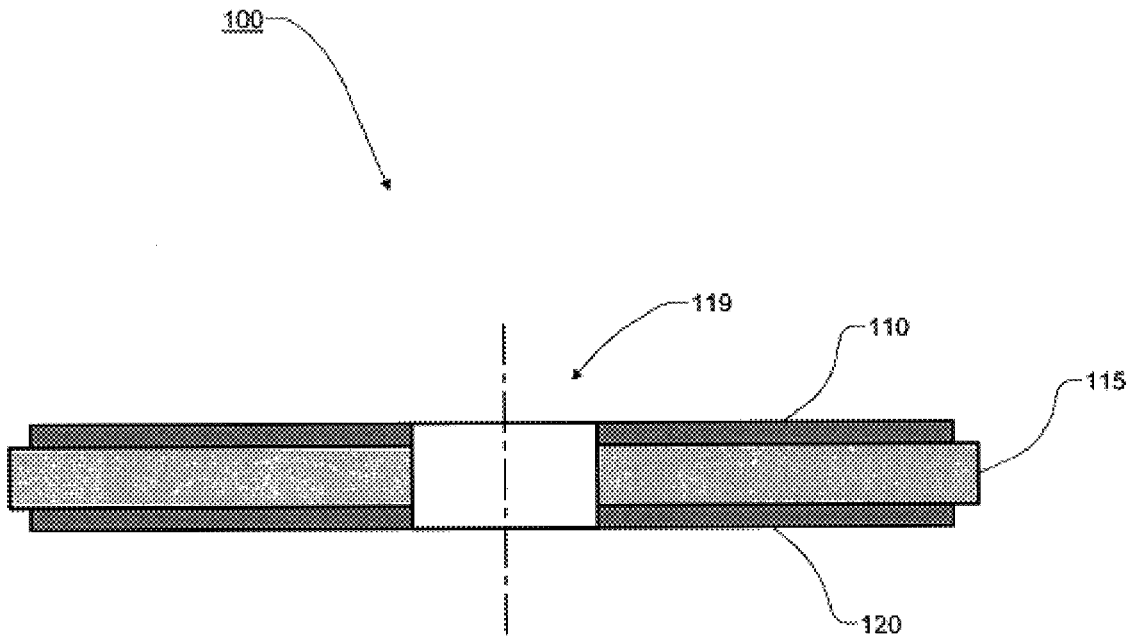
FIG. 1 is a perspective view of the geometry of an exemplary microhollow electrode with a center borehole according to this invention.

FIG. 1 shows a perspective view of the geometry of an exemplary microhollow electrode 100 according to this invention. As shown in FIG. 1, the microhollow electrode 100 comprises at least some of a cathode 110, a dielectric 115, an anode 120, and a center borehole 119.

As shown in FIG. 1, the microhollow electrode 100 consists of a plane-parallel cathode 110 and a plane-parallel anode 120 with a center borehole 119 through both the cathode 110 and the anode 120. The microhollow electrode 100 also includes the dielectric 115 as a spacer between the cathode 110 and the anode 120.

In various exemplary embodiments, either one or both of the cathode 110 and the anode 120 is formed from a conductive or semi-conductive material of any suitable thickness. In various exemplary embodiments, cathode 110 and the anode 120 are molybdenum foil of 100$\mu$m thickness.

The dielectric 115 can be formed from any non-conductive material and any suitable thickness. In various exemplary embodiments, the dielectric 115 is mica or alumia with a thickness of approximately 100 $\mu$m –200 $\mu$m.

The center borehole 119 forms an electrode cavity, which, in various exemplary embodiments, has a sub-millimeter diameter. In various exemplary embodiments, the diameter of the center borehole 119 is 100 $\mu$m.

Figure 2:
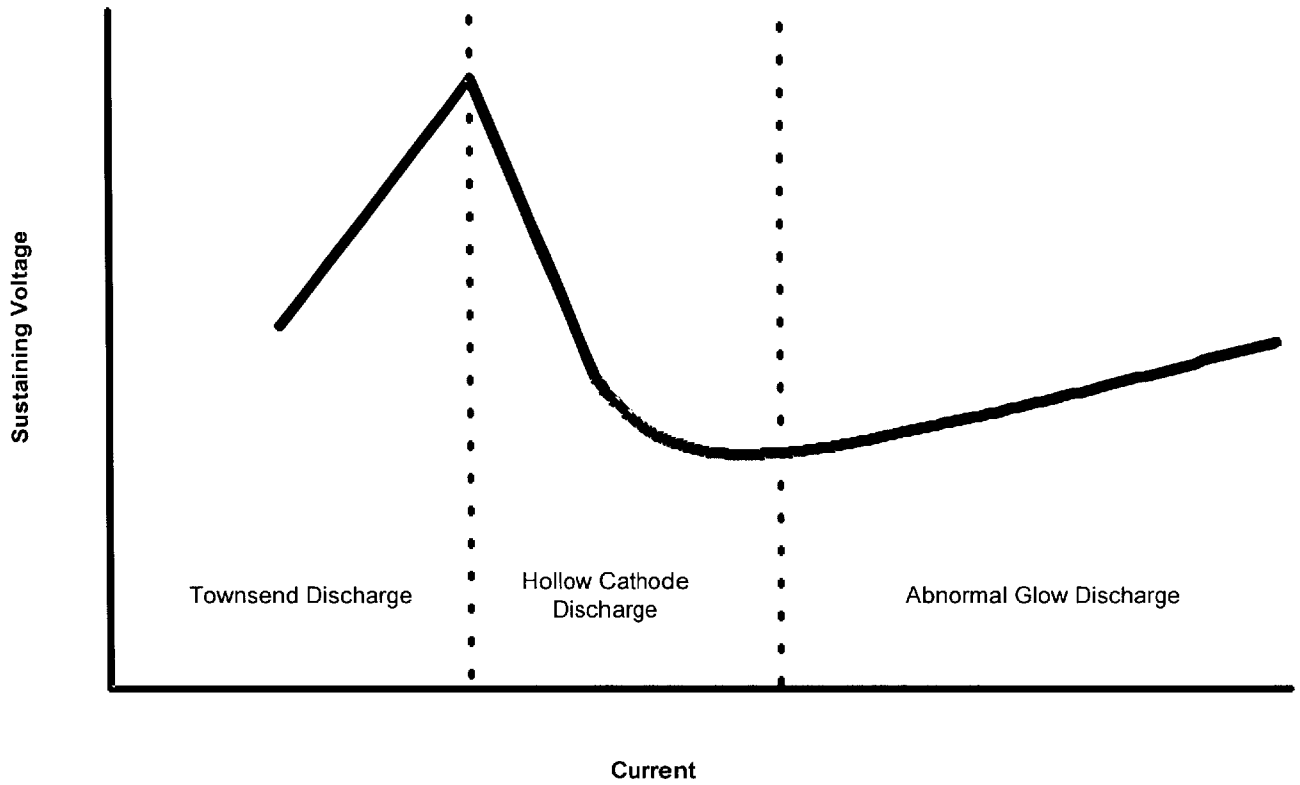
FIG. 2 is a graph of voltage verses current showing the discharge characteristics of one exemplary embodiment of the microhollow electrode with a center borehole according to this invention.

FIG. 2 is a graph of the discharge voltage and current characteristics for the microhollow electrode 100 of FIG. 1. As shown in FIG. 2, the current scale is logarithmic and the voltage versus current (V-I) characteristic of the microhollow electrode 100 discharge shows three distinct ranges of operation.

As shown in FIG. 2, the resistive V-I characteristic at low current, with an exponential increase in current with voltage, indicates that the discharge in this mode is a Townsend discharge. A schematic sketch of the discharge in this mode is shown in FIG. 3.

Figure 4:
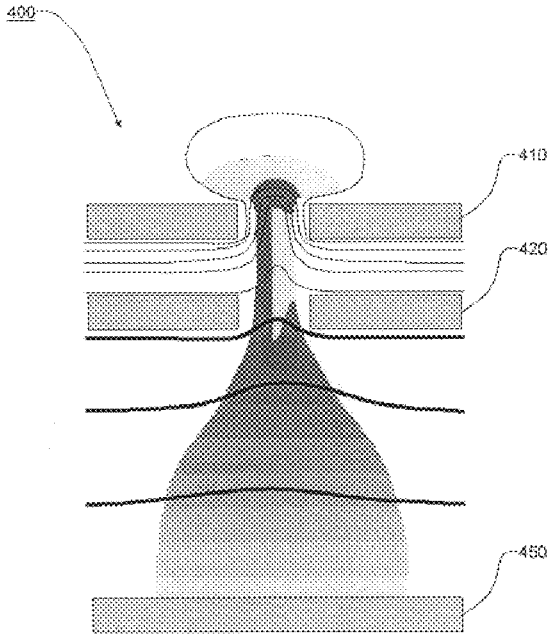
FIG. 4 is a side plan view of MHCD sustained glow discharge and the potential distribution with the MHCD operating in the hollow cathode discharge mode according to this invention.

FIG. 2 also shows that when the current is increased, the conductivity of the discharge column inside the electrode cavity increases and it forms a virtual anode. A schematic sketch of the MHCD sustained glow discharge with the MHCD operating in the hollow cathode discharge mode according to this invention is shown in FIG. 4.

Additionally, FIG. 2 also shows that in resistive current ranges, ranges where the slope of the V-I characteristic is positive, microhollow electrode discharges can be operated in parallel without or at least with small ballast. For being used as electron source, the relevant range of operation would be that at high current, where the discharge resistance increases (abnormal glow discharge). In various exemplary embodiments, the parallel operation of microhollow cathode discharges are in the range of current densities in excess of 100 A/cm$^2$.

Figure 3:
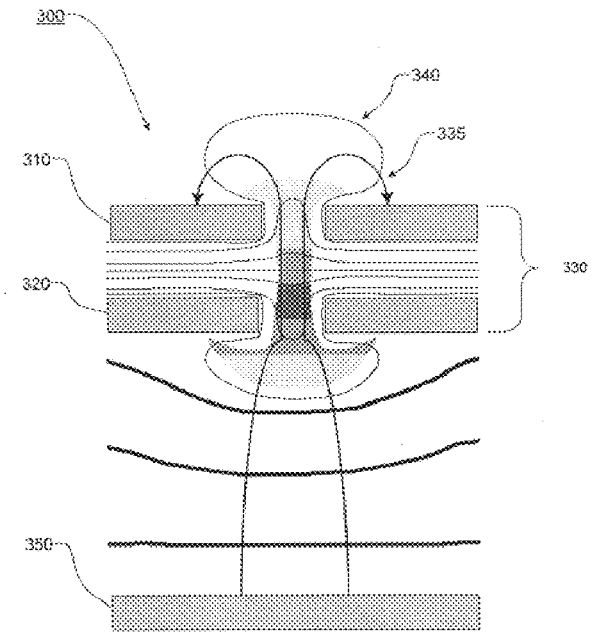
FIG. 3 is a side plan view of MHCD in the Townsend mode and potential distribution in the three-electrode system according to this invention.

FIG. 3 is a side plan view of a microhollow three-electrode discharge apparatus 300 in the Townsend mode. As shown in FIG. 3, the microhollow three-electrode discharge apparatus 300 includes at least a microhollow cathode 310, a microhollow anode 320, and an anode 350.

The microhollow cathode 310 and the microhollow anode 320 form the microhollow electrode 330. The elements of the microhollow electrode 330 correspond to and operate similarly to the same elements discussed above with respect to the microhollow electrode 100 of FIG. 1. However, the microhollow three-electrode discharge apparatus 300 also includes the anode 350.

The anode 350 can be formed from any conductive, semi-conductive, or semi-insulating material and any suitable thickness. In various exemplary embodiments, the anode 350 is formed from molybdenum foil of 100 $\mu$m thickness.

In various exemplary embodiments, the anode 350 is a positively biased electrode.

As shown in FIG. 3, the microhollow three-electrode discharge apparatus 300 includes field lines 335 and potential lines 340. In various exemplary embodiments, the field lines 335 are perpendicular to the potential lines 340 and the field lines 335 approximate the path of the electrons.

During operation of the microhollow three-electrode discharge apparatus 300 in the Townsend discharge mode, it is assumed that the product of pressure (p) times the electrode gap (d) is less than the pxd value in the minimum of the Paschen curve. Thus, the discharge develops along a path, from the outer face of one electrode, such as, for example, the microhollow cathode 310, to the outer face of the second electrode, such as, for example, the microhollow anode 320, rather than the shortest possible path, along the dielectric (not shown). At higher pressure, or larger gap between the electrodes, respectively, where this condition is not satisfied, the discharge develops inside the electrode cavity, such as, for example the center borehole (not labeled), and assumes a microhollow cylindrical shape.

FIG. 4 is a side plan view of a microhollow three-electrode discharge apparatus 400, according to this invention. As shown in FIG. 4, the microhollow three-electrode discharge apparatus 400 includes at least a microhollow cathode 410, a microhollow anode 420, and an anode 450.

The elements of the microhollow three-electrode discharge apparatus 400 correspond to and operate similarly to the same elements discussed above with respect to the microhollow three-electrode discharge apparatus 300 of FIG. 3. However, the microhollow three-electrode discharge apparatus 400 of FIG. 4 is operating in a hollow cathode discharge mode.

During operation, the change in potential distribution causes the electric field generated by the third electrode to become comparable to the electric field of the MHCD in the anode aperture. Thus, a discharge develops in the space between the MHCD and the anode 450.

When the current is increased, the conductivity of the discharge column inside the electrode cavity increases and forms a virtual anode. As shown in FIGS. 3 and 4, the electric field begins to change from a mainly axial to a more radial field concentrated at the cathode, this is the cathode fall.

When this occurs, the axial field is reduced to values required to compensate for electron losses in the virtual anode (positive column). The formation of this strong radial field at the perimeter of the microhollow cathode 410 causes a fraction of electrons generated at the microhollow cathode 410 through ion impact to gain such energy that they may oscillate through the axis region, unloading much of their energy through ionizing collisions in this region.

This microhollow cathode effect may lead to an increase in current with simultaneous decay in voltage (negative differential conductivity). With further increase in current, the normal microhollow cathode glow discharge expands over an increasing area at the surface of the microhollow cathode 410. However, since discharge expansion to areas beyond the circumference of the center borehole (not labeled) is related to a lengthening of the discharge path, the discharge voltage rises. As illustrated in FIG. 2 as the abnormal glow discharge region.

Extraction of electrons from the MHCD by means of anode 450, on the anode side of the MHCD geometry, requires that the electric field generated by the third electrode is on the same order as the field in the MHCD.

When operating in the Townsend mode, the typical electric fields in the microhollow electrode 330 are on the order of ten kV/cm. This requires very high voltages applied to the anode 350, which is placed at distance large compared to the gap of the MHCD. Therefore, the anode 350, when biased at a moderate voltage, does not influence the operation of the microhollow three-electrode discharge apparatus 400.

However, when the MHCD transfers in a mode where an axial electric field is replaced by a radial one, the electric field generated by the anode 450 only needs to be on the order of that in a positive column. In various exemplary embodiments, the electric field is on the order of one hundred V/cm to affect the MHCD. Thus, the potential in the microhollow anode plane is similar to an electron lens and the electrons in the microhollow electrode are rerouted to the anode 450, rather than drifting to the microhollow anode 420.

Figure 5:
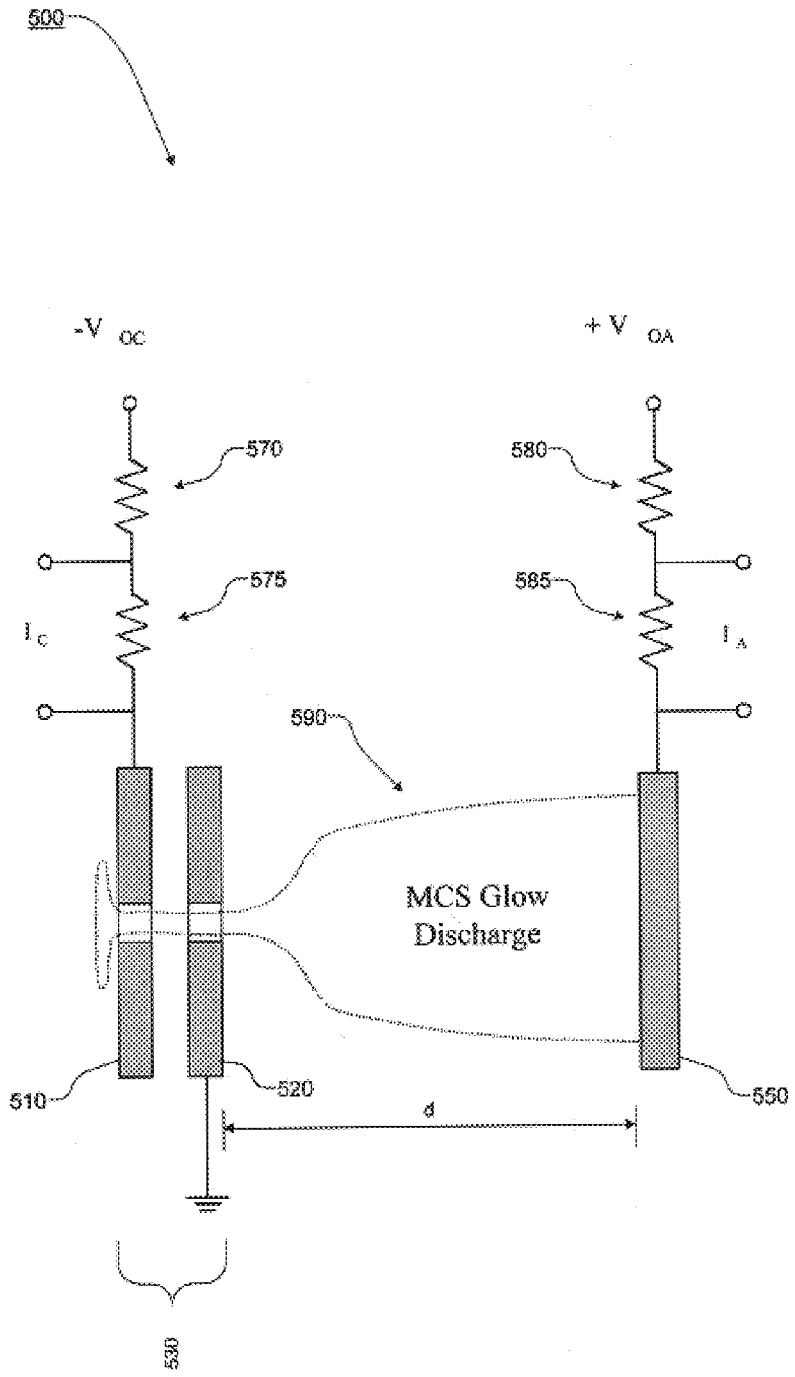
FIG. 5 is a schematic view of an electrode and electrical circuit configuration for use with this invention.

FIG. 5 is a schematic view of an electrode and electrical circuit configuration 500 for use with this invention. The electrical circuit configuration 500 includes at least some of a microhollow electrode 530 and an additional electrode 550 spaced at a variable distance, d, from the microhollow electrode 530. In various exemplary embodiments, the distance, d, is between 0 and 10 mm.

The microhollow electrode 530 comprises a microhollow cathode 510 and a microhollow anode 520. In various exemplary embodiments, the microhollow electrode 530 is the microhollow electrode 100 of FIG. 1.

Additionally, in various exemplary embodiments, the additional electrode 550 is the anode 350 of FIG. 3.

As shown in FIG. 5, the microhollow anode 520 is on ground potential. Furthermore, the microhollow cathode 510 is connected to an applied voltage Voc through series resistance 575 and series resistance 570. Additionally, the additional electrode 550 is connected to an applied voltage VOA through series resistance 585 and series resistance 580. Thus, the microhollow anode 520 is positive in relation to the microhollow cathode 510, and negative in relation to the additional electrode 550.

It should be understood that the series resistances 575 and 585 are supplied so that values for microhollow cathode current and additional electrode current can be measured. Therefore, the series resistances 575 and 585 are not essential to the design of the electrical circuit configuration 500.

In various exemplary embodiments, the applied voltage Voc and the applied voltage VOA is in the range from 100 V to 800 V, depending on current and gas pressure.

In various exemplary embodiments, the series resistance 570 and 580 are used to limit the discharge current in the MCS glow discharge and provide a very large potential drop. For example, in various exemplary embodiments, the series resistance 575 and 585 are 100 kΩ resistors, and the series resistance 570 and 580 are 1 kΩ resistors. Alternatively, series resistance 570 and series resistance 580 can be varied or replaced by a controlled current source.

Figure 6:
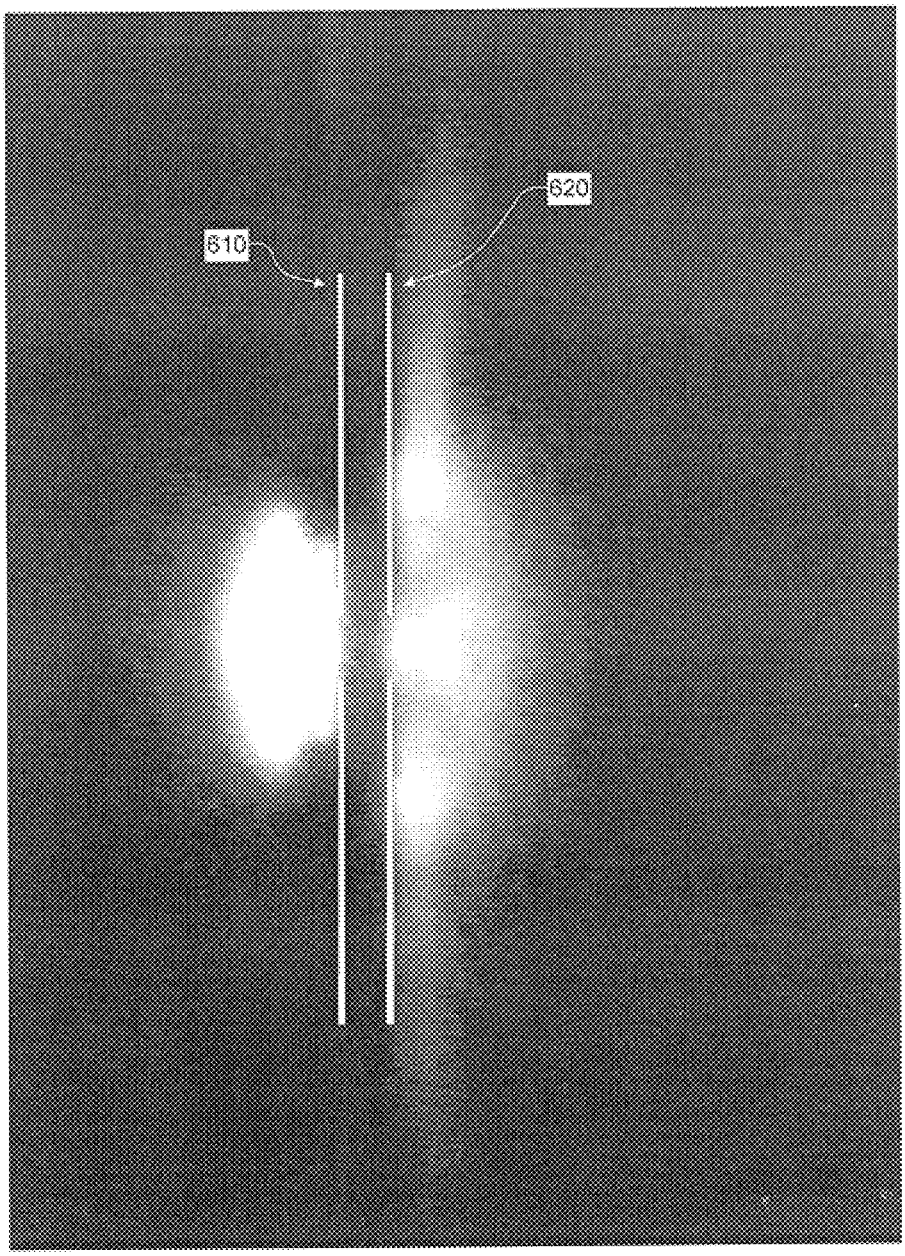
FIG. 6 is a photograph showing the MHCD, from an exemplary microhollow electrode with a center borehole according to this invention, in argon at 160 torr with the third electrode unbiased.

FIG. 6 is a photograph showing the MHCD, from an exemplary microhollow such as the electrode and electrical circuit configuration 500 of FIG. 5, in argon at 160 toff with the anode 550 unbiased.

The photograph of FIG. 6 shows an umbrella shaped plasma layer developed at the anode side 620 of the MHCD system. Additionally, the MHCD plasma does not extend into the electrode space; only a plasma layer at the circumference of the anode aperture is visible.

As seen in FIG. 6, the area of highest intensity in the center represents the plasma column, the outer areas the edges of the plasma layer at the anode surface.

Figure 7A:
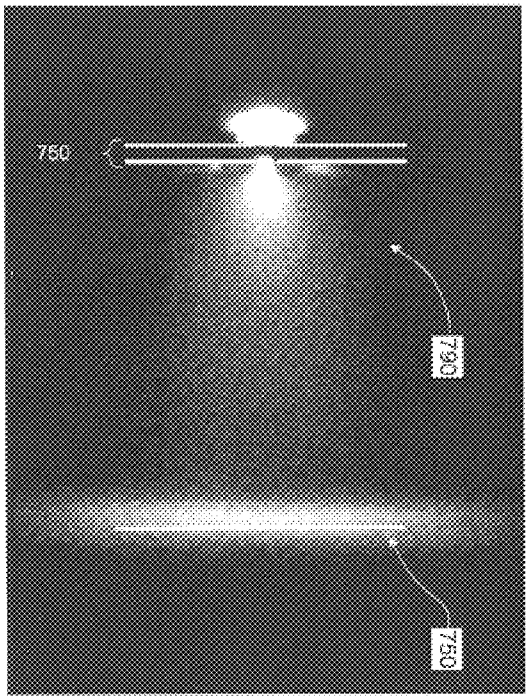
FIG. 7*a* is a photograph showing a MHCD and the predischarge, from an exemplary microhollow electrode with a center borehole according to this invention, in argon at 160 torr at a voltage of 66 V applied to the third electrode.

FIG. 7*a* is a photograph showing a MHCD and the predischarge, from an exemplary microhollow electrode with a center borehole according to this invention, in argon at 160 torr at avoltage of 66 V applied to the additional electrode 550, of FIG. 5.

As shown in FIG. 7*a*, by increasing bias potential, voltage $V_{OA}$, at the additional electrode 550, of FIG. 5, the current flow to the additional electrode 550, increases exponentially. However, the current flow to the additional electrode 550 is still small compared to the MHCD current. In this phase, the predischarge phase, a luminous plasma 790 develops in the space between plasma cathode 750 and anode 750. Although the umbrella like structure of the MHCD anode, as shown in FIG. 6, is still present in this mode, electrons originating from the center of the MHCD are carried increasingly -with increasing $V_A$– to the anode 750.

Figure 7B:
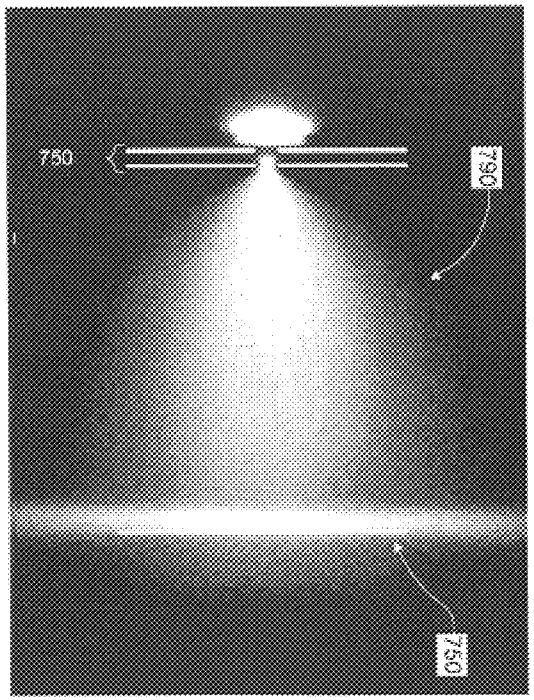
FIG. 7*b* is a photograph showing a MHCD and the microhollow cathode sustained (MCS) glow discharge, from an exemplary microhollow electrode with a center borehole according to this invention, for 77 V anode potential.

FIG. 7b is a photograph showing a MHCD and the microhollow cathode sustained (MCS) glow discharge, from an exemplary microhollow electrode with a center borehole according to this invention, for 77 V anode potential and $^{V}$MHCD$^{=259V,}$ $^{I}$MHCD$^{=1.27mA,}$ and $^{I}$MCS=1.27mA.

Eventually, at a certain threshold voltage, the plasma umbrella shown in FIG. 7*a*, becomes detached from the MHCD-anode and a bell shaped discharge column is formed. In this mode, the microhollow cathode sustained (MCS) glow mode, the current in the MCS glow is identical with the MHCD current.

Figure 8:
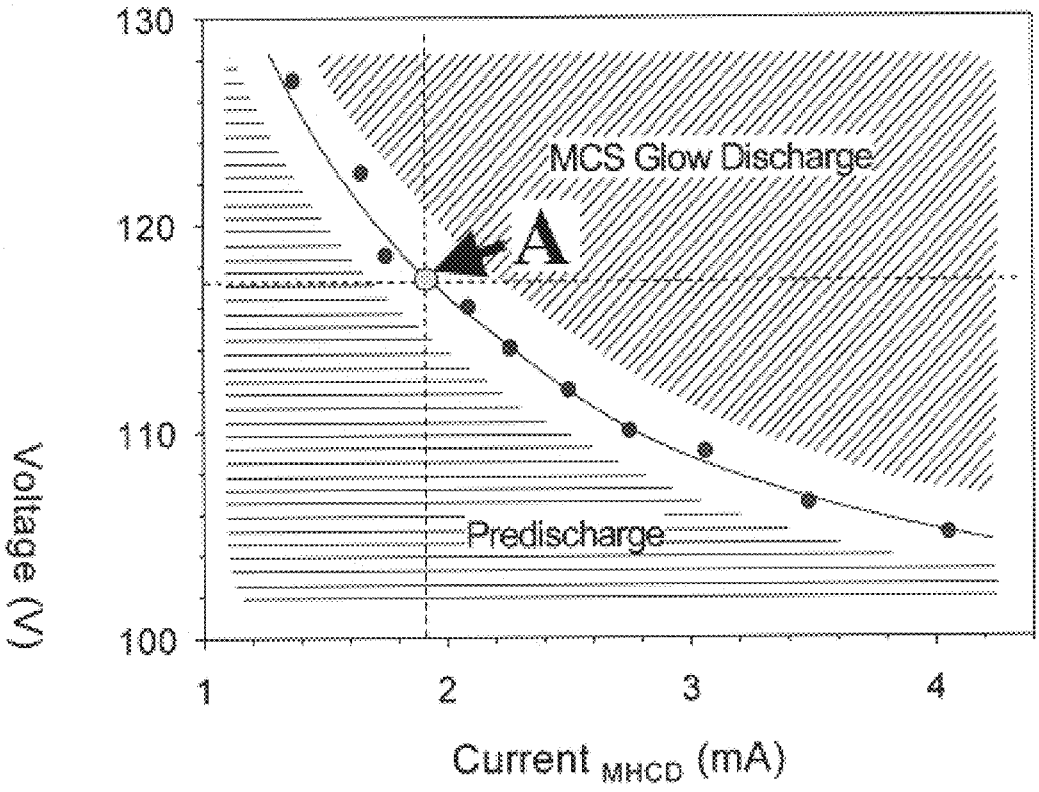
FIG. 8 is a graph of voltage verses current showing the range of operation of the predischarge and the MCS glow discharge in argon at 160 torr of one exemplary embodiment of the microhollow electrode with a center borehole according to this invention.

FIG. 8 is a graph of voltage verses current showing the range of operation of the predischarge and the MCS glow discharge in argon at 160 torr of one exemplary embodiment of the microhollow electrode with a center borehole according to this invention.

As shown in FIG. 8, besides the dependence on the applied voltage, VA, the appearance of the glow between MHCD and anode is also determined by the MHCD current. The solid curve in FIG. 8 correspond to the threshold values of MHCD current and anode potential where the transition from the predischarge to the MCS glow is observed. The dashed vertical line in FIG. 8 represent the mode of operation where the glow between plasma cathode and anode is controlled by VA, at constant MHCD current. The dashed horizontal line in FIG. 8 represent a mode of operation where the MCS glow discharge is controlled by the current in the MHCD, with the anode voltage, VA, kept constant. Point A represents the transition from the predischarge to the MCS glow discharge for both cases.

Figure 9A:
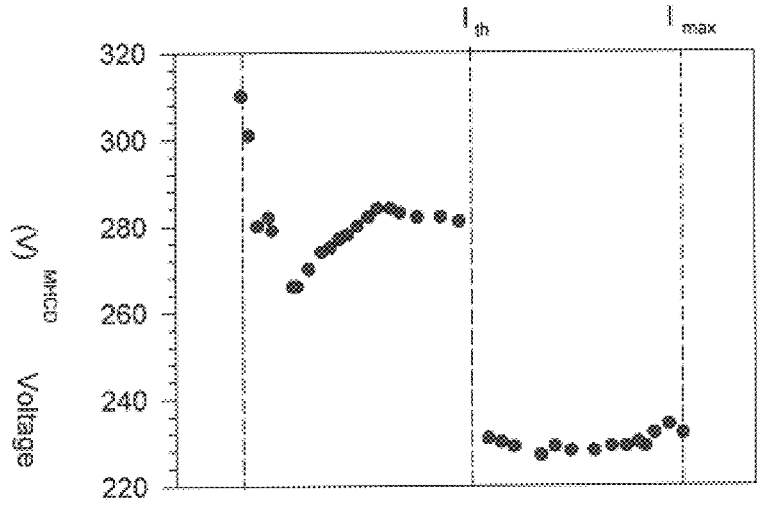
FIG. 9*a* is a graph of MHCD voltage measured at the anode versus MHCD current at a constant anode potential of 100 V in argon at 160 torr of one exemplary embodiment of the microhollow electrode with a center borehole according to this invention.
Figure 9B:
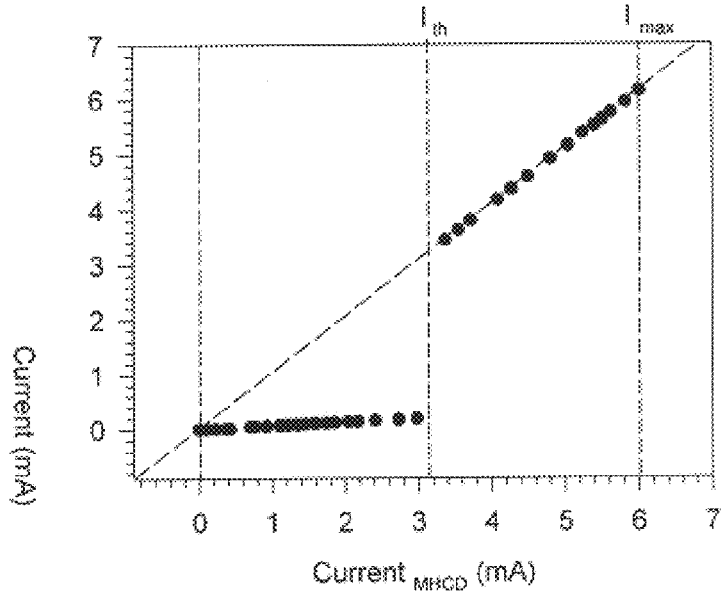
FIG. 9*b* is a graph of MCS current measured at the anode versus MHCD current at a constant anode potential of 100 V in argon at 160 torr of one exemplary embodiment of the microhollow electrode with a center borehole according to this invention.
Figure 10:
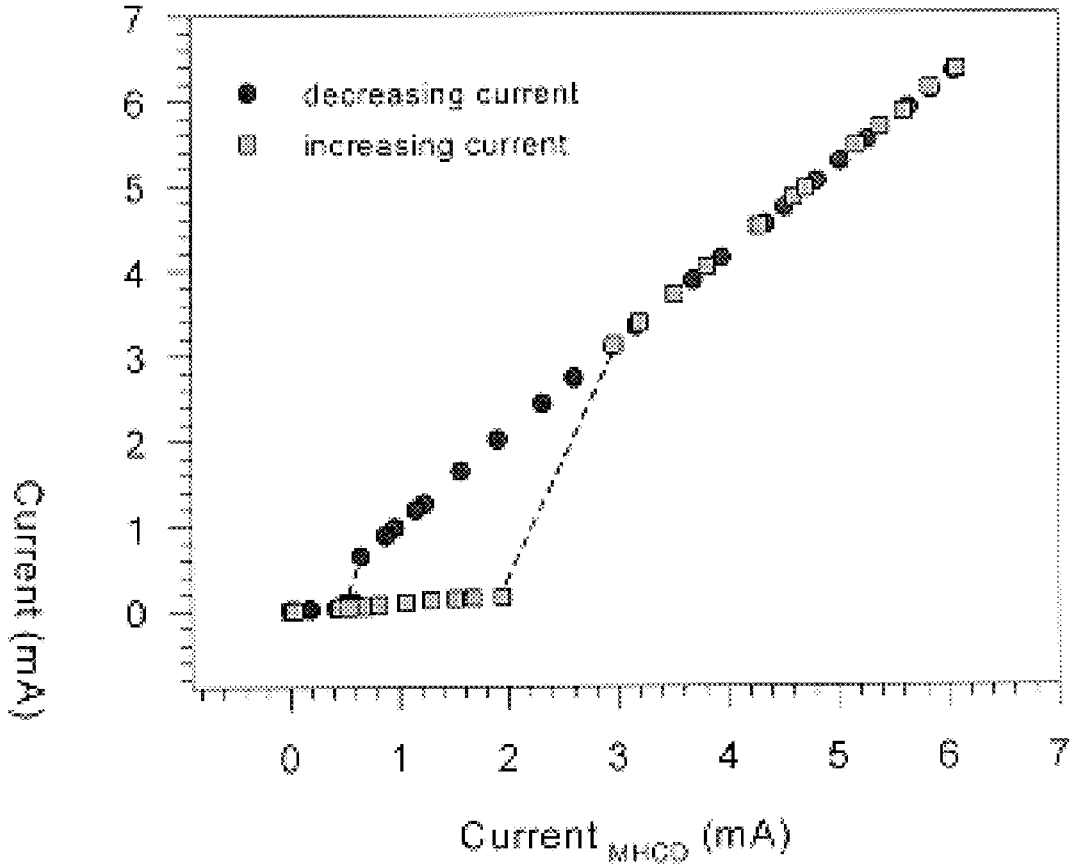
FIG. 10 is a graph showing the hysteresis in the transition from predischarge to MCS glow discharge of one exemplary embodiment of the microhollow electrode with a center borehole according to this invention.
Figure 11:
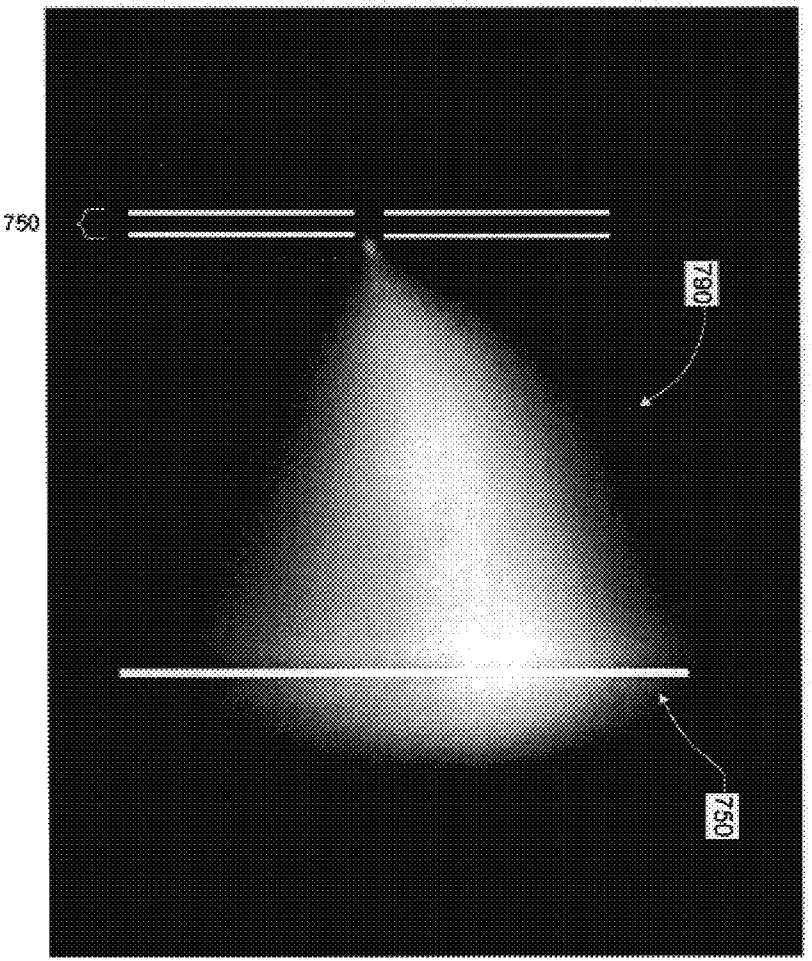
FIG. 11 is a photograph showing a MCS glow discharge in argon at atmospheric pressure with an anode potential of 213 V.

The development of the current in the glow between plasma cathode and anode 550 with increasing microhollow cathode current (along a horizontal line as shown in FIG. 8: $V_A$ constant) and the corresponding V-I characteristic of the MHCD is shown in FIG. 9. Up to an MHCD current of 3 mA the current in the glow discharge is small compared to the MHCD current This is the predischarge phase, where the axial MHC electric field in the microhollow geometry exceeds the external field. At the current threshold value in the two fields, the internal and the external fields become comparable and the current is completely rerouted from the microhollow anode to the anode 550. This means, that the MHCD current and the MCS glow discharge current become identical. This switching effect is correlated with a sudden drop in the MHCD voltage. The results depicted in FIG. 9 were obtained by varying the MHCD current from low to high values. By changing the current from high to low values, the transition from high current mode to the low current mode occurs at much lower values of the MHCD current (FIG. 10).

The upper limit in MCS glow discharge current and voltage, respectively, is determined by the onset of the glow-to-arc transition (GAT). Then the discharge current rises by several orders of magnitude. Simultaneously the forward voltage drops to a few tens of volts. The V-I characteristics in FIGS. 9 and 10 were obtained for discharges in argon at 160 torr and an electrode gap of 5 mm. The pressure could be increased to 1 atm without reaching the threshold value for the GAT. A side-on photograph of a dc discharge in argon at 1 atm is shown in FIG. 9 between electrodes, which are 2 mm apart. The plasma is bell shaped, with its diameter at the plasma cathode determined by the hole diameter (100 $\mu$m). Its diameter increases to 2 mm at the anode.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A direct current high pressure glow discharger, comprising:

a first electrode;

a second electrode, spaced from the first electrode;

at least one microhollow formed through the first electrode and the second electrode;

a third electrode spaced from the first electrode and the second electrode; and electrical means for connecting electrical energy to at least some of the first electrode, the second electrode, and the third electrode at a voltage and current for producing microhollow discharges in each of the at least one microhollow formed through the first electrode and the second electrode.

2. The direct current high pressure glow discharger of claim 1, wherein the first electrode is spaced from the second electrode a distance approximately equal to a diameter of the at least one microhollow.

3. The direct current high pressure glow discharger of claim 1, wherein the third electrode is spaced from the first electrode and the second electrode a distance greater than a distance between the first electrode and the second electrode.

4. The direct current high pressre glow discharger of claim 1, wherein the first electrode is separated from the second electrode by a dielectric.

5. The direct current high pressure glow discharger of claim 4, wherein the dielectric includes at least one microhollow formed through the dielectric, wherein the at least one microhollow is formed similarly to the at least one microhollow through the first electrode and the second electrode.

6. The direct current high pressure glow discharger of claim 1, wherein the first electrode, the second electrode, and the third electrode is an anode are plan-parallel.

7. The direct current high pressure glow discharger of claim 1, wherein the first electrode is an anode.

8. The direct current high pressure glow discharger of claim 1, wherein the second electrode is an cathode.

9. The direct current high pressure glow discharger of claim 1, wherein the third electrode is an anode.

10. The direct current high pressure glow discharger of the claim 1 wherein the at least one microhollow is formed to have a diameter ranging from 5 to 200 $\mu$M.

11. The direct current high pressure glow discharger of the claim 1 wherein the at least one microhollow is formed to have a diameter of 100 $\mu$m.

12. A method of stabilizing high pressure glow discharges, comprising:

providing a first electrode;

positioning a second electrode apart from the first electrode;

forming at least one microhollow through the first electrode and the second electrode;

positioning a third electrode apart from the first and the second electrode.

13. The method of claim 12, wherein the second electrode is positioned apart from the first electrode a distance approximately equal to a diameter of the at least one microhollow.

14. A method of generating a glow plasma discharge comprising:

positioning a first electrode and a second electrode in a plan-parallel relationship with a space therebetween;

providing a dielectric between the first electrode and the second electrode;

positioning a third electrode spaced apart from the first electrode and the second electrode;

forming at least one microhollow through the first electrode, the second electrode, and the dielectric; and generating an electric field between the first electrode, the second electrode, and the third electrode.

15. The method of the claim 14 wherein the at least one microhollow is formed to have a diameter ranging from 5 to 200 $\mu$m.

16. The method of the claim 14 wherein the at least one microhollow is formed to have a diameter of 100 $\mu$m.

17. The method of claim 14 wherein the distance is between the first or second electrode and the third electrode is between 0 and 10 mm.

* * * * *